US012662758B2

(12) United States Patent
Monteagudo et al.

(10) Patent No.: US 12,662,758 B2
(45) Date of Patent: Jun. 23, 2026

(54) YARN FLUFFING TOOL

(71) Applicants: Robert Monteagudo, Trumbull, CT (US); Joanne Buccini, Trumbull, CT (US)

(72) Inventors: Robert Monteagudo, Trumbull, CT (US); Joanne Buccini, Trumbull, CT (US)

( * ) Notice: Subject to any disclaimer, the term of this patent is extended or adjusted under 35 U.S.C. 154(b) by 0 days.

(21) Appl. No.: 18/754,751

(22) Filed: Jun. 26, 2024

(65) Prior Publication Data

US 2026/0002296 A1 Jan. 1, 2026

(51) Int. Cl.
*D02J 1/02* (2006.01)
*D02J 1/16* (2006.01)

(52) U.S. Cl.
CPC .. *D02J 1/02* (2013.01); *D02J 1/16* (2013.01)

(58) Field of Classification Search
CPC ..... D02J 1/02; D02J 1/16; D02J 1/00; D02J 3/00; D02J 3/02; D02J 3/04; A47J 43/1093; A47J 43/1087
See application file for complete search history.

(56) References Cited

U.S. PATENT DOCUMENTS 1,895,833 A * 1/1933 Baker ..... A47J 43/1087 241/301
3,087,280 A * 4/1963 Seliger ..... A47G 7/07 47/41.13
5,788,368 A * 8/1998 Anderson ..... A47J 43/1093 416/70 R
6,389,744 B1 * 5/2002 Pugh ..... A01G 9/12 248/156
6,935,070 B2 * 8/2005 Ramirez ..... A47G 23/0306 47/41.01
2011/0085412 A1 * 4/2011 Filipitsch ..... B01F 27/13 366/343
2015/0157076 A1 * 6/2015 Rivera ..... B44C 5/06 29/428
2025/0057363 A1 * 2/2025 Vazquez ..... A47J 43/27

* cited by examiner

*Primary Examiner* — Uyen T Nguyen
(74) *Attorney, Agent, or Firm* — Michael A. Blake

(57) ABSTRACT

A yarn fluffing tool comprising: a dowel, the dowel comprising a first end and a second end; a first loop extending from the first end, the first loop having a generally smooth shape except for a first irregular portion where the first loop terminates at the first end and that first irregular portion has an irregular shape, the first loop is bent in a first direction away from the longitudinal directions of the dowel; a second loop extending from the first end and adjacent to the first loop, the second loop having a generally smooth shape except for a second irregular portion, where the second loop is basically a mirror image shape of the first loop; and where the first irregular portion and the second irregular portion overlap with each other.

9 Claims, 4 Drawing Sheets

YARN FLUFFING TOOL

TECHNICAL FIELD

The present invention relates to a yarn fluffing tool, and more particularly to a yarn fluffing tool comprising two overlapping loops.

BACKGROUND

Bulky or 5 weight yarn is approximately twice as thick as worsted weight yarn. Sometimes referred to as chunky, craft, or rug yarn, it usually works up quickly using larger needles or hooks. This yarn is great for a heavier, cozy sweater, or for rugs and throws. Super Bulky or 6 weight yarn is a very thick yarn that works up quickly on large needles and hooks. Most often it is used for cowls, scarves, and hats. A thicker yarn weight is Jumbo or 7 weight. These yarns are sometimes called chunky yarns. These types of yarn often comes vacuumed packed, and the chunkiness, bulkiness, and/or "jumboness" of the yarn is usually compressed due to the vacuum packing process. Users often have a hard time putting the yarn back to its original chunky, bulky, super bulky, or jumbo condition from its compressed vacuum packed condition.

Thus there is a need for yarn fluffing tool that can fluff yarn back to its chunky, bulky, super bulky, or jumbo condition and that overcomes the above-listed and other disadvantages.

SUMMARY OF THE INVENTION

The invention relates to a yarn fluffing tool comprising: a dowel, the dowel comprising a first end and a second end; a first loop extending from the first end, the first loop having a generally smooth shape except for a first irregular portion where the first loop terminates at the first end and that first irregular portion has an irregular shape, the first loop is bent in a first direction away from the longitudinal directions of the dowel; a second loop extending from the first end and adjacent to the first loop, the second loop having a generally smooth shape except for a second irregular portion where the second loop terminates at the first end and that second irregular portion has an irregular shape, the second loop is bent in a second direction away from the longitudinal directions of the dowel, where the second loop is basically a mirror image shape of the first loop; and where the first irregular portion and the second irregular portion overlap with each other.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
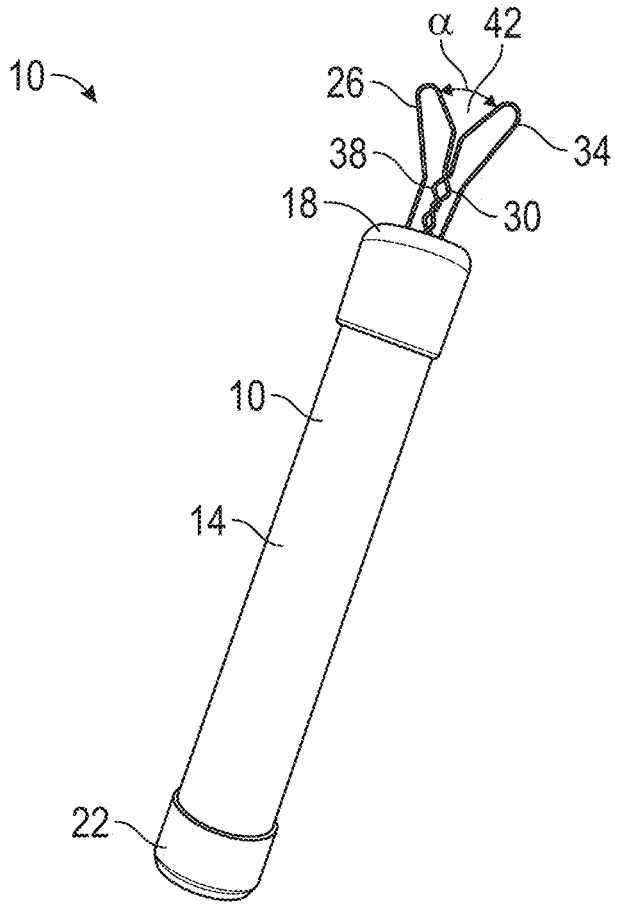
FIG. 1 is a front close up view of the yarn fluffing tool.

FIG. 1 shows a front close up view of the yarn fluffing tool 10. The yarn fluffing tool 10 comprises a dowel 14 with a first end 18 and a second end 22. Extending from the first end is a first wire loop 26. The first loop 26 has a generally elongated oval shape that is bent to the left (in this view). The wire that comprises the first loop 26 is generally smooth, that is the wire extends generally in a linear and/or curved fashion until it has a sawtooth/zig zag portion 30. The sawtooth/zig portion may also be described as an irregular shape. The sawtooth/zig zag portion 30 terminates at or inside the first end 18. Also extending from the first end is a second wire loop 34. The second wire loop 34 may be a mirror image of the first wire loop 26. The second loop 34 has a generally elongated oval shape that is bent to the right (in this view). The wire that comprises the second loop 34 is generally smooth, that is the wire extends generally in a linear and/or curved fashion until it has a sawtooth/zig zag portion 38. The sawtooth/zig zag portion 38 terminates at or inside the first end 18. The second wire loop 34 may be adjacent and overlapping the first wire loop 26 at the sawtooth/zig zag portions 30, 38. The two loops 26, 34 form an angled opening 42 that is configured to guide a piece of a yarn into and between the two loops 26, 34. The angled opening 42 may have an angle $\alpha$ of about 70° to about 120°, and in the shown embodiment is about 85°. The wire loops 26, 34 may be made out of any suitable materials, including but not limited to wire, plastic, fiberglass, composites, wood, etc. The dowel may also be made out of any suitable material including but not limited to wood, metal, composites, plastic, etc. In other embodiments, the sawtooth/zig zag portions 30,38 may have different shapes, such as but not limited to sinusoidal, square wave, triangle wave, pulse wave, etc. The first end and second end may have plastic caps. The plastic cap on the first end may be where the first and second loops extend and terminate from, and the plastic cap may be changed or replaced for different sized loops and angled openings. In other embodiments, the cap may be made out of rubber, metal, or any other suitable material.

Figure 2:
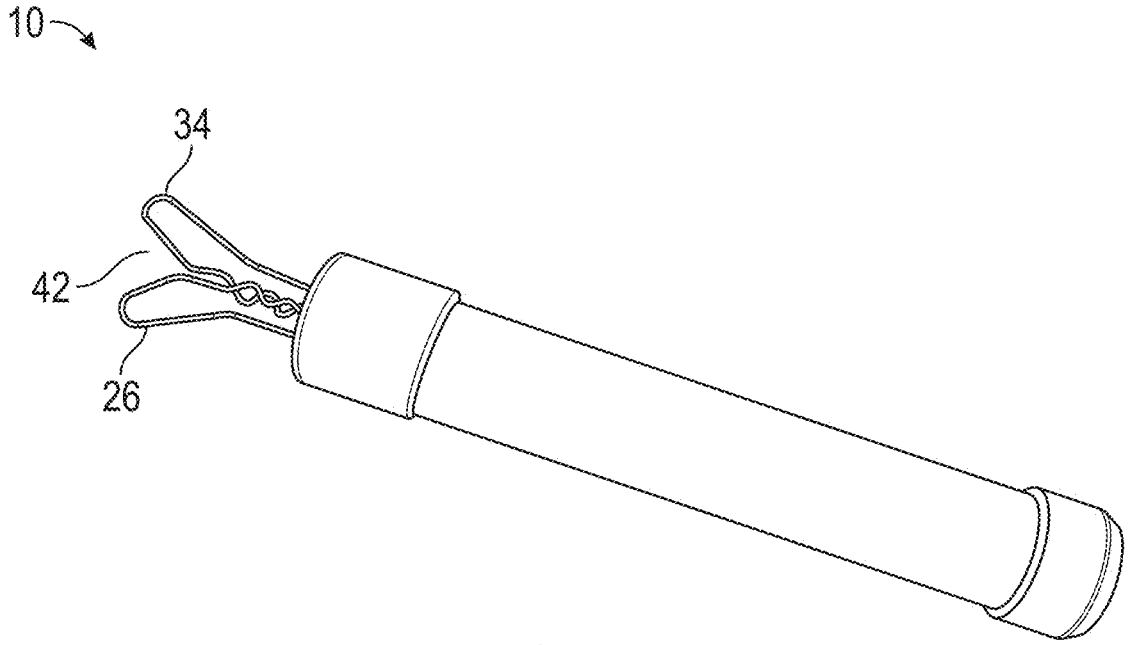
FIG. 2 is a front view of the yarn fluffing tool.

FIG. 2 is another view of the yarn fluffing tool 10.

Figure 3:
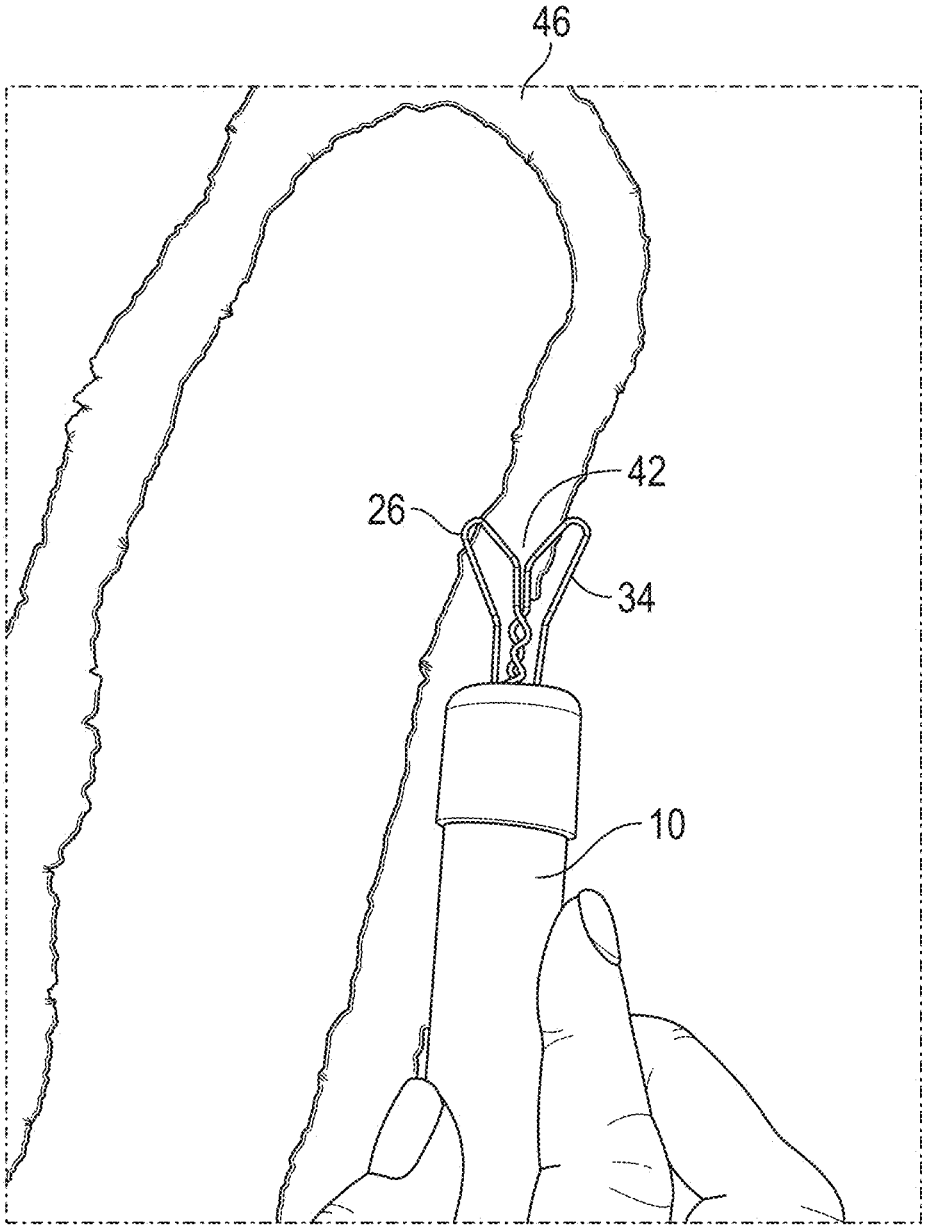
FIG. 3 is a view of the yarn fluffing tool adjacent to a length of yarn.

FIG. 3 shows the yarn fluffing tool 10 with a length of bulky yarn 46 adjacent to the tool. In this figure, the yarn 46 is about to be slid between the two loops 26, 34 at the angled opening 42.

Figure 4:
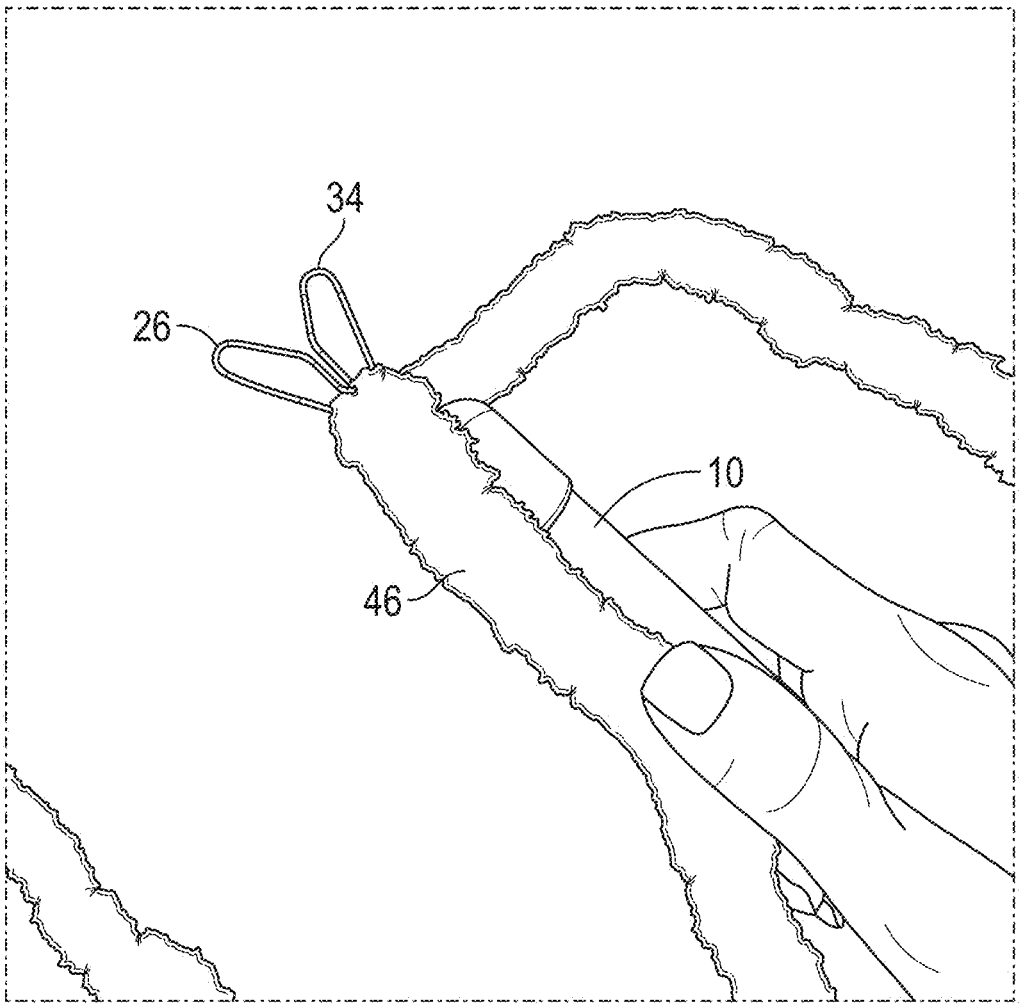
FIG. 4 is a view of the yarn fluffing tool with the length of yarn inserted into the tool.

FIG. 4 shows the yarn 46 after it has been slid into the angled opening 42 and is now located at the overlapping sawtooth/zig zag portions 30,38 (not visible in this view due to the yarn 46) of the wire loops 26, 34. In use, the user will slide the yarn 46 along its length through the overlapping sawtooth/zig zag portions 30,38 which will cause the yarn to fluff up and expand to its state prior to being compressed, via vacuum packing in one embodiment.

Figure 5:
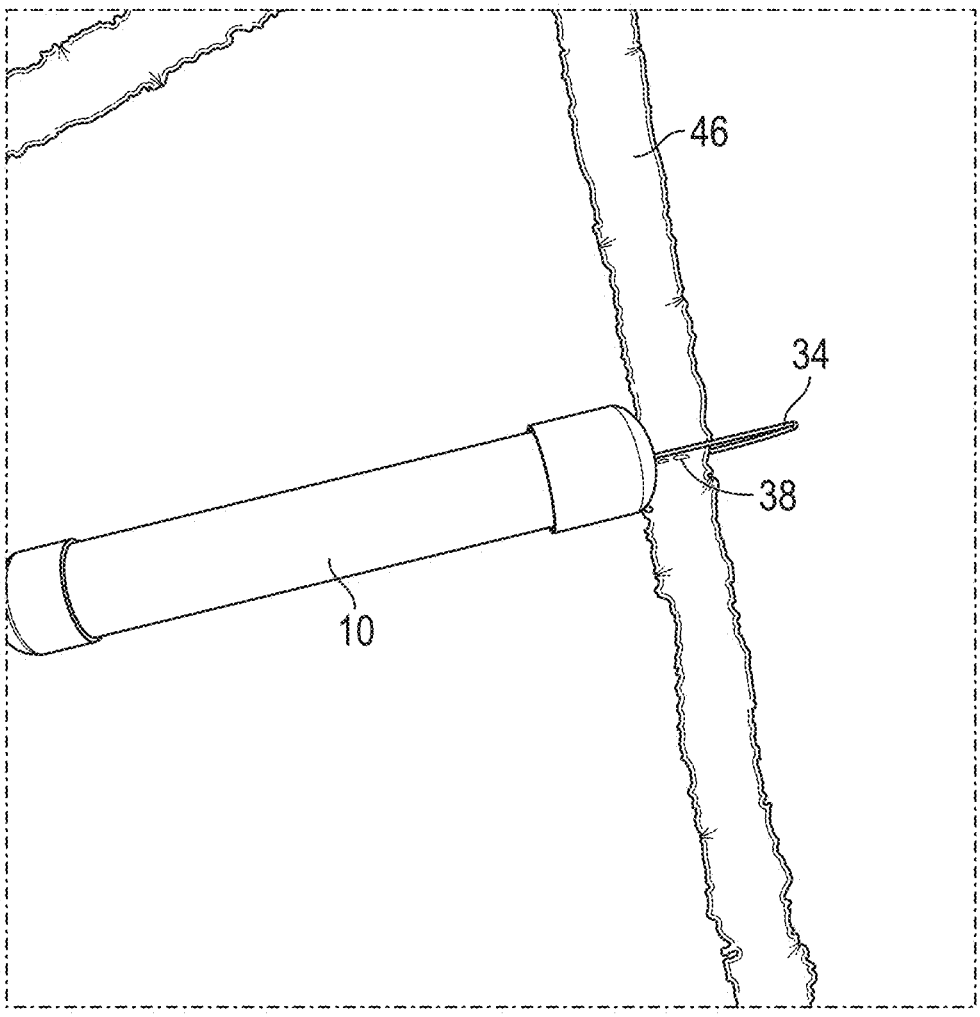
FIG. 5 is a side view of the yarn fluffing tool with the length of yarn inserted into the tool.

FIG. 5 shows a side view of the yarn fluffing tool 10 with the yarn 46 located between the two sawtooth/zig zag portions 30,38.

The disclosed yarn fluffing tool has many advantages. The tool is inexpensive. It can be used easily with chunky, bulky, super bulky, or jumbo yarn. A user simply inserts a length of yarn into the tool via the angled opening, slide the yarn so it is between the sawtooth/zig zag portions of the two loops, and slide the yarn along its length through the yarn fluffing tool one or more times.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof.

Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A yarn fluffing tool comprising:

a dowel, the dowel comprising a first end and a second end, the dowel having a length and circumference so that a user's hand can comfortably enfold the dowel in one hand and work the yarn fluffing tool on a length of yarn;

a first loop extending from the first end, the first loop having a generally smooth shape, wherein the generally smooth shape is generally linear or curved, except for a first irregular portion where the first loop terminates at the first end and that first irregular portion has an irregular shape, the first loop is bent in a first direction away from a longitudinal direction of the dowel the first irregular portion abuts the first end, and wherein the first irregular portion generally has sudden changes in direction and/or sharp angles;

a second loop extending from the first end and adjacent to the first loop, the second loop having a generally smooth shape except for a second irregular portion where the second loop terminates at the first end and that second irregular portion has an irregular shape, the second loop is bent in a second direction away from the longitudinal direction of the dowel, wherein the second loop is basically a mirror image shape of the first loop; and wherein the first irregular portion and the second irregular portion are sawtooth or zig zag shape, and at least two sawtooth portions or two zig zags of the first irregular portion overlap and abut with at least two sawtooth portions or two zig zags of the second irregular portion thereby forming at least two openings bounded by the at least two sawtooth portions or two zig zags of the first irregular portion and at least two sawtooth portions or two zig zags of the second irregular portion, and the second irregular portion abuts the first end; and wherein the generally smooth shape of the first loop and the generally smooth shape of the second loop are adjacent and angled to each other to form an entrance at an angle $\alpha$ of about 70° to about 120°, and the entrance is configured to accept a portion of yarn and guide the yarn into the at least two openings.

2. The yarn fluffing tool of claim 1, wherein the loops are made from wire.

3. The yarn fluffing tool of claim 1, wherein the dowel is made from wood or plastic.

4. The yarn fluffing tool of claim 1, wherein the yarn fluffing tool is configured to fluff chunky yarn.

5. The yarn fluffing tool of claim 1, wherein the yarn fluffing tool is configured to fluff bulky, super bulky, or jumbo yarn.

6. The yarn fluffing tool of claim 1, wherein the loops are made from plastic.

7. The yarn fluffing tool of claim 1 wherein the first end and second ends are covered with plastic caps.

8. The yarn fluffing tool of claim 1 wherein the first end and second ends are covered with metal caps.

9. A yarn fluffing tool comprising:

a dowel, the dowel comprising a first end and a second end, the dowel having a length and circumference so that a user's hand can comfortably enfold the dowel in one hand and work the yarn fluffing tool on a length of yarn;

a first loop extending from the first end, the first loop having a generally smooth shape, wherein the generally smooth shape is generally linear or curved, except for a first irregular portion where the first loop terminates at the first end and that first irregular portion has an irregular shape, the first loop is bent in a first direction away from a longitudinal direction of the dowel and the first irregular portion abuts the first end, and wherein the first irregular portion generally has sudden changes in direction and/or sharp angles;

a second loop extending from the first end and adjacent to the first loop, the second loop having a generally smooth shape except for a second irregular portion where the second loop terminates at the first end and that second irregular portion has an irregular shape, the second loop is bent in a second direction away from the longitudinal direction of the dowel, wherein the second loop is basically a mirror image shape of the first loop; and wherein the first irregular portion and the second irregular portion are sinusoidal shape, square wave shape, triangle wave shape, or pulse wave shape, and at least two troughs and crests of the sinusoidal shape, two squares, two triangle, or two pulses of the first irregular portion overlap and abut with at least two troughs and crests of the sinusoidal shape, two squares, two triangle, or two pulses of the second irregular portion, thereby forming at least two openings bounded by the at least two troughs and crests of the first irregular portion and at least two troughs and crests of the second irregular portion, and the second irregular portion abuts the first end; and wherein the generally smooth shape of the first loop and the generally smooth shape of the second loop are adjacent and angled to each other to form an entrance at an angle $\alpha$ of about 70° to about 120°, and the entrance is configured to accept a portion of yarn and guide the yarn into the at least two openings.

* * * * *